US009439475B2

(12) United States Patent
Ikenaka

(10) Patent No.: US 9,439,475 B2
(45) Date of Patent: Sep. 13, 2016

(54) METHOD FOR PRODUCING SHOE UPPER AND SHOE UPPER

(71) Applicant: Shima Seiki Mfg., Ltd., Wakayama-shi, Wakayama (JP)

(72) Inventor: Masamitsu Ikenaka, Wakayama (JP)

(73) Assignee: Shima Seiki Mfg., Ltd., Wakayama-shi, Wakayama (JP)

( * ) Notice: Subject to any disclaimer, the term of this patent is extended or adjusted under 35 U.S.C. 154(b) by 0 days.

(21) Appl. No.: 14/899,334

(22) PCT Filed: Mar. 28, 2014

(86) PCT No.: PCT/JP2014/059174
§ 371 (c)(1),
(2) Date: Dec. 17, 2015

(87) PCT Pub. No.: WO2014/203585
PCT Pub. Date: Dec. 24, 2014

(65) Prior Publication Data

US 2016/0143394 A1 May 26, 2016

(30) Foreign Application Priority Data

Jun. 21, 2013 (JP) ..... 2013-131028

(51) Int. Cl.
*D04B 1/22* (2006.01)
*A43B 23/02* (2006.01)
(Continued)

(52) U.S. Cl.
CPC ..... *A43B 23/026* (2013.01); *A43B 1/04* (2013.01); *A43B 23/0205* (2013.01);
(Continued)

(58) Field of Classification Search
CPC ..... D04B 1/22; D04B 1/24; D04B 7/30; A43B 23/0205; A43B 23/0255; A43B 23/04; A43B 23/0206
See application file for complete search history.

(56) References Cited

U.S. PATENT DOCUMENTS 6,910,288 B2 * 6/2005 Dua ..... D04B 1/16 12/146 C
8,595,878 B2 * 12/2013 Huffa ..... D04B 1/22 12/145

(Continued)

FOREIGN PATENT DOCUMENTS

JP 11-323608 A 11/1999
JP 2012-512698 A 6/2012
WO 2010/080182 A1 7/2010

OTHER PUBLICATIONS

International Search Report issued in PCT/JP2014/059173 dated Jun. 24, 2014, 1 page.

*Primary Examiner* — Danny Worrell
(74) *Attorney, Agent, or Firm* — Rothwell, Figg, Ernst & Manbeck, P.C.

(57) ABSTRACT

There is provided a method for producing a shoe upper capable of producing a shoe upper having a double structure with high productivity. A tubular inner side knitted fabric portion (19) to become an inner side portion of the shoe upper and a tubular outer side knitted fabric portion (11) to become an outer side portion of the shoe upper are knitted with the inner side knitted fabric portion (19) and the outer side knitted fabric portion (11) lined on left and right on the needle beds and with foot insertion opening corresponding portions (110, 190) of the knitted fabric portions (11, 19) connected (process α). In this case, at least one of the inner side knitted fabric portion (19) and the outer side knitted fabric portion (11) is knitted using a fusible knitting yarn including a heat fusible yarn. The inner side knitted fabric portion (19) is tucked in an interior of the outer side knitted fabric portion (11) to form a shoe upper having a double structure (process β). The shoe upper having the double structure is fitted to a last and a thermal process is carried out (process γ).

8 Claims, 3 Drawing Sheets

(51) Int. Cl.
*A43B 1/04* (2006.01)
*A43B 23/04* (2006.01)

(52) U.S. Cl.
CPC ..... *A43B 23/0255* (2013.01); *A43B 23/04* (2013.01); *D04B 1/22* (2013.01); *D10B 2403/023* (2013.01); *D10B 2403/0332* (2013.01); *D10B 2501/043* (2013.01)

(56) References Cited

U.S. PATENT DOCUMENTS

| | | | | |
|---|---|---|---|---|
| 8,701,232 | B1 * | 4/2014 | Droege | D04B 1/123 12/142 R |
| 2010/0154256 | A1 * | 6/2010 | Dua | D04B 1/106 66/170 |
| 2012/0318026 | A1 * | 12/2012 | Dua | D04B 1/106 66/170 |

* cited by examiner

METHOD FOR PRODUCING SHOE UPPER AND SHOE UPPER

CROSS REFERENCE TO RELATED APPLICATION

This application is a 35 U.S.C. 371 National Phase Entry Application from PCT/JP2014/059174, filed Mar. 28, 2014, which claims the benefit of Japanese Patent Application No. JP2013-131028 filed on Jun. 21, 2013, the disclosures of which are incorporated by reference in their entirety.

TECHNICAL FIELD

The present invention relates to a shoe upper having a double structure, and a method for producing the shoe upper.

BACKGROUND ART

In recent years, attempts have been made to knit a shoe upper using a flat knitting machine. If a thick knitting yarn is used when knitting the shoe upper, the surface of the shoe upper may become uneven, thus affecting the appearance and the wearing comfortableness. If a thin knitting yarn is used for knitting the shoe upper, on the other hand, the surface of the shoe upper becomes smooth and satisfactory appearance is obtained, but the thickness of the shoe upper may not be sufficiently ensured. In this case, the fitting feeling and the strength of the shoe upper may be impaired.

As a solution to the above problem, a technique of knitting the knitted fabric having a double structure can be used, as described in Patent Document 1, for example. In Patent Document 1, a sock and a glove having a double structure are knitted. The knitting procedure of the sock and glove is substantially similar, and the case of knitting the sock will be described below by way of example. First, an inner side knitted fabric portion of the sock having the double structure is knitted from a toe toward a foot insertion opening, and then an outer side knitted fabric portion is knitted from a foot insertion opening toward a toe following the foot insertion opening of the inner side knitted fabric portion (whether to knit the inner side knitted fabric portion or the outer side knitted fabric portion first is arbitrary). As a result, a sock in which the foot insertion openings of the inner side knitted fabric portion and the outer side knitted fabric portion are connected is knitted. When using such sock, the inner side knitted fabric portion is tucked in the interior of the outer side knitted fabric portion to obtain the double structure.

PRIOR ART DOCUMENT

Patent Document

[Patent document 1] Japanese Patent Application Publication No. 11-323608

DISCLOSURE OF THE INVENTION

Problems to be Solved by the Invention

With increasing demands for shoe upper obtained by knitting in recent years, improvement in the knitting efficiency of the shoe upper is desired. However, the technique of Patent Document 1 cannot meet such desire. This is because when applying the technique of Patent Document 1 to produce the shoe upper having the double structure, the inner side knitted fabric portion and the outer side knitted fabric portion of the shoe upper are sequentially knitted, and thus the knitting time for substantially two socks is required.

The present invention has been made in light of the foregoing, and an object of the present invention is to provide a method for producing a shoe upper that can produce the shoe upper having a double structure with high productivity, and a shoe upper obtained by such producing method.

Means for Solving the Problems

An aspect of the present invention relates to a method for producing a shoe upper of producing a shoe upper using a flat knitting machine including at least a pair of a front and a back needle bed and a yarn feeder for feeding a knitting yarn; the method including the following processes α to γ.

[Process α] Knit a tubular inner side knitted fabric portion to become an inner side portion of the shoe upper and a tubular outer side knitted fabric portion to become an outer side portion of the shoe upper with the inner side knitted fabric portion and the outer side knitted fabric portion lined on left and right on the needle beds of the flat knitting machine and with foot insertion opening corresponding portions of the knitted fabric portions connected. In this case, at least one of the inner side knitted fabric portion and the outer side knitted fabric portion is knitted using a fusible knitting yarn including a heat fusible yarn. The foot insertion opening corresponding portions are portions that configure the rim of the foot insertion opening of the shoe upper when the inner side knitted fabric portion is tucked in the interior of the outer side knitted fabric portion.

[Process β] Tuck the inner side knitted fabric portion in an interior of the outer side knitted fabric portion to form a shoe upper having a double structure.

[Process γ] Fit the shoe upper having the double structure to a last (foot model) and carry out a thermal process. In the process γ, the outer side knitted fabric portion and the inner side knitted fabric portion are adhered with the heat fusible yarn melted during the thermal process, and the shoe upper having the double structure is formed into a shape corresponding to the last.

According to an aspect of the method for producing the shoe upper of the present invention, in the process α, the inner side knitted fabric portion and the outer side knitted fabric portion may be knitted from a heel toward a toe.

According to another aspect of the method for producing the shoe upper of the present invention, in the process α, an inner side cutout extending from the foot insertion opening corresponding portion of the inner side knitted fabric portion toward a toe and an outer side cutout extending from the foot insertion opening corresponding portion of the outer side knitted fabric portion toward the toe may be formed.

According to another aspect of the method for producing the shoe upper of the present invention, knitting of thickening at least a part of the inner side knitted fabric portion and the outer side knitted fabric portion may be carried out. For example, [1] at least a part of the inner knitted fabric portion is made thick and the thickness of the outer side knitted fabric portion is made even; [2] the thickness of the inner side knitted fabric portion is made even and at least a part of the outer side knitted fabric portion is made thick; and [3] at least a part of the inner side knitted fabric portion and at least a part of the outer side knitted fabric portion are made thick. In the case of [3], the thickened portion of the inner side knitted fabric portion and the thickened portion of the outer side knitted fabric portion may be overlapped or may not be overlapped in the shoe upper having the double structure.

An aspect of the present invention relates to a shoe upper having a foot insertion opening. The shoe upper of the invention includes an outer side knitted fabric portion, and an inner side knitted fabric portion overlapped in an interior of the outer side knitted fabric portion; wherein the outer side knitted fabric portion and the inner side knitted fabric portion are adhered by a melted heat fusible yarn. In the shoe upper of the invention, a foot insertion opening corresponding portion of the outer side knitted fabric portion and a foot insertion opening corresponding portion of the inner side knitted fabric portion are connected. with a knitting yarn, and stitches of the foot insertion opening corresponding portion of the outer side knitted fabric portion and stitches of the foot insertion opening corresponding portion of the inner side knitted fabric portion are directed in the same direction in a length direction of the shoe upper.

Effects of the Invention

According to the method for producing the shoe upper of the present invention, the shoe upper of the present invention can be produced with high productivity. This is because the inner side knitted fabric portion and the outer side knitted fabric portion that configure the shoe upper are lined on left and right on the needle beds when knitted. The knitted fabric portions can be knitted at one time by knitting the inner side knitted fabric portion and the outer side knitted fabric portion lined on left and right, whereby the knitting zone in the knitting width direction becomes longer by the amount the knitted fabric portions are lined on left and right, and the knitting speed can be easily accelerated.

According to the method for knitting the shoe upper of knitting the inner side knitted fabric portion and the outer side knitted fabric portion from the heel toward the toe, the shoe upper can be more efficiently produced compared to when knitting the knitted fabric portions from the toe toward the heel. The reason therefor will be described in detail in the embodiment.

With the formation of the inner side cutout and the outer side cutout extending from the foot insertion opening corresponding portions of the inner side knitted fabric portion and the outer side knitted fabric portion toward the toe, a slit extending from the foot insertion opening of the shoe upper toward the toe can be formed by the cutouts of the knitted fabric portions when the inner side knitted fabric portion is tucked in the interior of the outer side knitted fabric portion in the process β. A tongue can be formed on the slit.

At least a part of the inner side knitted fabric portion and the outer side knitted fabric portion is thickened, so that the shoe upper can be reinforced. For example, the shoe upper can be thickened at a position of a heel where pressure tends to act, a position of arch of a foot where tension tends to act, a position of the foot insertion opening corresponding portion as shown in the embodiment and the like.

A bagginess of the inner side knitted fabric portion tucked in the interior of the outer side knitted fabric portion can be prevented and the inner side knitted fabric portion is avoided from becoming creased by knitting the inner side knitted fabric portion to be smaller than the outer side knitted fabric portion.

BEST MODE FOR CARRYING OUT THE INVENTION

Figure 1:
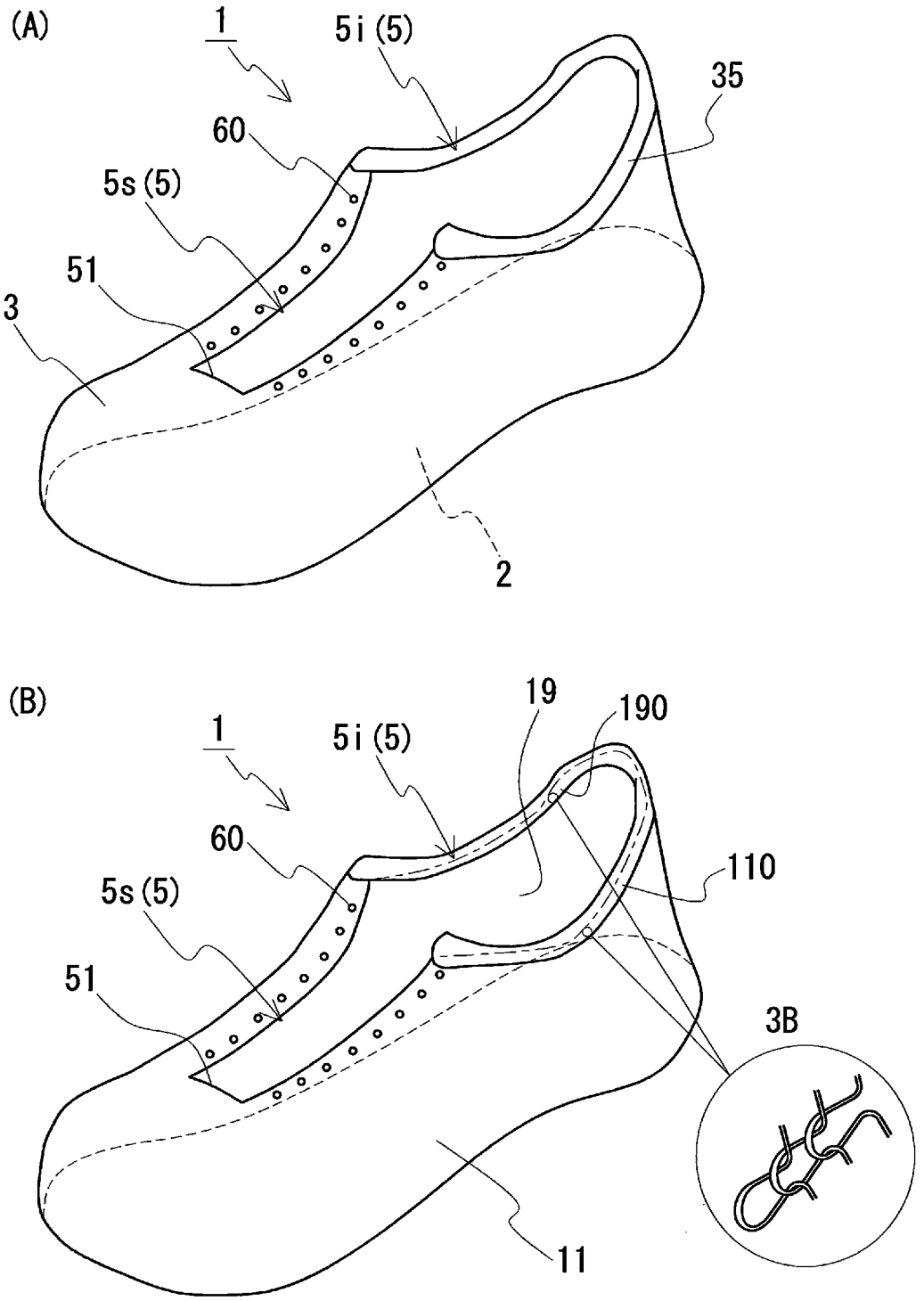
FIGS. 1(A) and 1(B) are schematic perspective views of a shoe upper shown in a first embodiment.

Embodiments of the shoe upper and the method for producing the same of the present invention will be described below based on the drawings. A two-bed flat knitting machine including at least a pair of a front and a back needle bed and in which stitches can be transferred between the front and back needle beds is used to produce the shoe upper.

First Embodiment

<<Shoe Upper>>

In a first embodiment, a shoe upper having a double structure will be described. As shown in FIG. 1(A), when a shoe upper 1 is divided from functional standpoints, it can be divided into an instep cover section 3 that covers a portion on an instep side of a foot of a wearer, and a sole cover section 2 that covers a portion of a sole of the wearer. The instep cover section 3 and the sole cover section 2 are integrally knitted in a seamless manner. The shoe upper 1 can be used as is as a shoe, or a shoe may be obtained by attaching an outer sole (not shown) made of resin and the like to the outer side of the sole cover section 2 configuring the shoe upper 1.

A shoe opening 5 is formed on an upper side of the instep cover section 3. The shoe opening 5 includes a foot insertion opening 5*i* to which the wearer inserts the foot, and a slit 5*s* extending from the foot insertion opening 5*i* toward the toe side. A foot insertion opening rim 35, which is a portion in the vicinity of the foot insertion opening 5*i* in the instep cover section 3 is formed to be thicker than other portions. Furthermore, an eyelet hole 60, which is a hole for passing a shoelace, is formed at a position of the slit 5*s* in the instep cover section 3. The eyelet hole 60 is not required for a shoe that does not use a shoelace. An end 51 of the slit 5*s* is at a position closer to the toe of the shoe upper 1, and a base of a tongue (not shown) can be connected to the end 51. The shoe upper 1 does not need to include the slit 5*s*, of course.

The sole cover section 2 is a portion to become the shoe sole when the shoe upper 1 is used as is as the shoe. If the outer sole is attached to the outer side of the sole cover section 2, the sole cover section 2 functions as an insole of the shoe. In either case, the sole cover section 2 covers the entire surface of the sole of the wearer.

When dividing the shoe upper 1 from the standpoint of the method for producing the shoe upper, as will be described later, it can be divided into an outer side knitted fabric portion 11 and an inner side knitted fabric portion 19 overlapped in the interior of the outer side knitted fabric portion 11, as shown in FIG. 1(B). The outer side knitted fabric portion 11 configures the outer side portion of the instep cover section 3 and of the sole cover section 2 of FIG. 1(A), and the inner side knitted fabric portion 19 configures the inner side portion of the instep cover section 3 and of the sole cover section 2. The outer side knitted fabric portion 11 and the inner side knitted fabric portion 19 are adhered by a melted heat fusible yarn.

A connecting boundary of the outer side knitted fabric portion 11 and the inner side knitted fabric portion 19 is at a position indicated with a chain dashed. line in the vicinity of the foot insertion opening 5*i* (corresponding to foot insertion opening rim 35 of FIG. 1(A)). A foot insertion opening corresponding portion 110 of the outer side knitted fabric portion 11 and a foot insertion opening corresponding portion 190 of the inner side knitted fabric portion 19 sandwiching the connecting boundary indicated. with the chain dashed line are connected with a knitting yarn. Furthermore, the stitches of the foot insertion opening corresponding portion 110 and the stitches of the foot insertion opening corresponding portion 190 are directed in the same direction in the length direction of the shoe upper 1, or the toe direction in the present embodiment. The stitches of the shoe upper 1 of the present embodiment knitted according to the knitting processes, to be described later, are entirely directed toward the toe side.

<<Method for Producing Shoe Upper>>

The shoe upper 1 is produced roughly by the following three steps.

[Process α] Knit the outer side knitted fabric portion 11 and the inner side knitted fabric portion 19.

[Process β] Tuck the inner side knitted fabric portion 19 in the interior of the outer side knitted fabric portion 11 to form the shoe upper 1 having a double structure.

[Process γ] Perform thermal process on the shoe upper 1 having the double structure.

[Process α]

Figure 2:
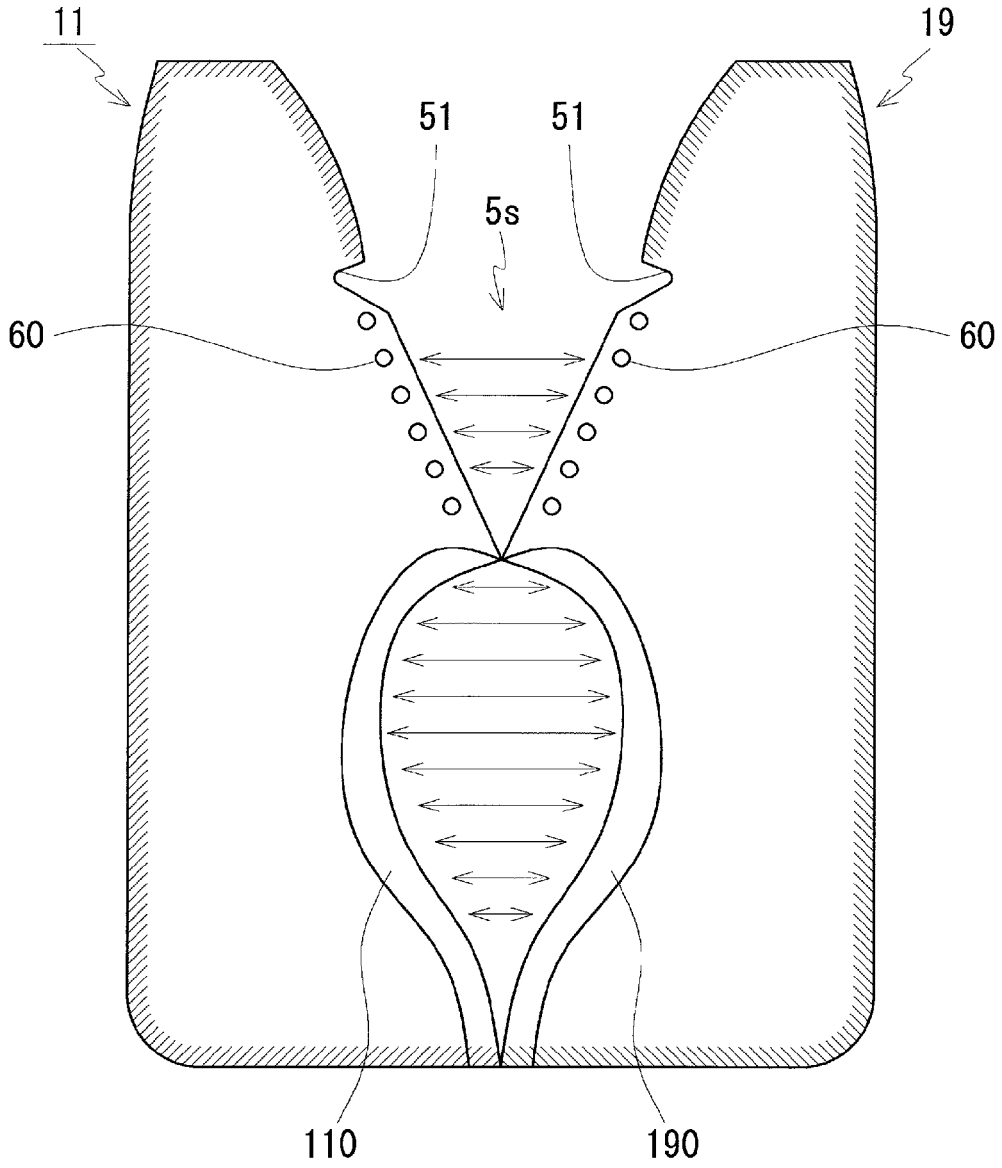
FIG. 2 is a schematic view showing a pattern of the shoe upper shown in the first embodiment.

In the process α, as shown with a pattern of FIG. 2, the outer side knitted fabric portion 11 and the inner side knitted fabric portion 19 are knitted in a state lined on the left and the right, when knitting the shoe upper 1. FIG. 2 shows each left side portion of the outer side knitted fabric portion 11 and the inner side knitted fabric portion 19 configuring the shoe upper 1, and each right side portion of the knitted fabric portions 11, 19 is assumed to be arranged on a far side in the plane of drawing of FIG. 2. The left side portion and the right side portion of each knitted fabric portion 11 (19) are in a state connected at a position indicated with hatching in the figure, and the outer side knitted fabric portion 11 and the inner side knitted fabric portion 19 are in a state connected at a position indicated with an arrow in a right and left direction (position of foot insertion opening corresponding portions 110, 190, and position to become an edge of the slit 5*s* where the eyelet holes 60 are formed). That is, in the process α, one tubular knitted fabric including the knitted fabric portions 11, 19 is knitted. Needless to say, the shape of the foot is right-left asymmetric, and thus the knitting width and the like of the right side portion and the left side portion of the shoe upper 1 are desirably changed in accordance with the shape of the foot.

An actual knitting procedure will now be described with reference to a schematic view of FIG. 3. The shoe upper 1 is knitted by being divided into regions I to V (seam is not provided between each of the regions I to V) for the sake of convenience. The region I is a region corresponding to a portion of a heel of the shoe upper 1, the region II is a region corresponding to a portion of the foot insertion opening 5*i*, the region III is a region corresponding to a portion from the foot insertion opening 5*i* to an intermediate portion of the slit 5*s*, and the region IV is a region corresponding to a portion from the intermediate portion to the end of the slit 5*s*, and the region V is a region corresponding to the portion of the toe (see also FIG. 1). The inner side knitted fabric portion 19 is knitted to be smaller than the outer side knitted fabric portion 11 through the regions I to V.

In the process α, a set up portion 11*s* of the outer side knitted fabric portion 11 and a set up portion 19*s* of the inner side knitted fabric portion 19 are first knitted. In the present embodiment, the outer side knitted fabric portion 11 and the inner side knitted fabric portion 19 are knitted with the same fusible knitting yarn. The fusible knitting yarn is a knitting yarn including a heat fusible yarn. The outer side knitted fabric portion 11 and the inner side knitted fabric portion 19 may, of course, be knitted with different knitting yarns. For example, a case of knitting the inner side knitted fabric portion 19 with the fusible knitting yarn including the heat fusible yarn, and knitting the outer side knitted fabric portion 11 with a normal knitting yarn not including the heat fusible yarn is considered. In such case, the fusible knitting yarn and the normal knitting yarn may be connected by intarsia knitting and the like at the connecting boundary of the knitted fabric portions 11, 19 indicated with a chain dashed line.

The region I of the outer side knitted fabric portion 11 and the inner side knitted fabric portion 19 is knitted based on the set up portions 11*s*, 19*s*. In the region I, the knitting of gradually reducing the number of stitches to knit in a knitting width direction is carried out, and thereafter, the knitting of gradually increasing the number of stitches to knit in the knitting width direction is carried out. When increasing the number of stitches to knit in the knitting width direction, a portion indicated with an arrow is joined in a wale direction. Furthermore, in the region I, the knitting of gradually reducing the number of stitches to knit in the knitting width direction is carried out. The number of times to carry out the knitting of reducing and the knitting of increasing the number of stitches to knit is not particularly limited. The shape of the heel of the shoe upper 1 can be formed to a smooth three-dimensional shape by increasing the number of times.

Following the knitting of the heel, the region II of the knitted fabric portions 11, 19 is knitted. In the region II, inside narrowing of reducing the stitches is carried out at the position (see bent arrow in the figure) on the inner side of the end in the knitting width direction, and then the inside widening of increasing the stitches is carried out at the position (see bent arrow in the figure) on the inner side of the end in the knitting width direction. With such inside narrowing and inside widening, the shape of the foot insertion opening rim 35 of the shoe upper 1 shown in FIG. 1(A) is formed. The foot insertion opening rim 35 is curved toward the lower side of the shoe upper 1 so as to avoid the ankle of the wearer.

Following the knitting of the portion corresponding to the foot insertion opening 5*i*, the region III of the knitted fabric portions 11, 19 is knitted. In the region III as well, the inside narrowing is carried out at the position (see bent arrow in the figure) on the inner side of the end in the knitting width direction, and the portion up to the intermediate portion of the slit 5*s* of the shoe upper 1 shown in FIG. 1 is knitted.

The foot insertion opening corresponding portions 110, 190 surrounded with a dotted line of the regions II, III are preferably thickened. The foot insertion opening rim 35 (see FIG. 1(A)) can be reinforced by thickening the foot insertion opening corresponding portions 110, 190. As the knitting of thickening, the knitting for one course may be carried out by dividing the knitting into a plurality of times while mixing miss knitting, for example. Specifically, a first knitting of knitting on the odd-numbered stitches and missing the even-numbered stitches within the range of the foot insertion opening corresponding portions 110, 190 is carried out, and thereafter, a second knitting of knitting on the even-numbered stitches and missing the odd-numbered stitches within the range of the foot insertion opening corresponding portions 110, 190 is carried out. The two stitch rows are thereby overlapped in a thickness direction, thus thickening the foot insertion opening corresponding portions 110, 190. In addition, the knitting of repeating the tuck knitting to overlap cross-over yarns may be carried out, thus thickening the foot insertion opening corresponding portions 110, 190.

The region IV of the knitted fabric portions 11, 19 is then knitted. In the region IV, the outer side knitted fabric portion 11 and the inner side knitted fabric portion 19 are knitted in a separated state. Each knitted fabric portion 11, 19 is knitted using different yarn feeders. Specifically, an outer side cutout 11*c* extending from the foot insertion opening corresponding portion 110 of the outer side knitted fabric portion 11 toward the toe is formed, and an inner side cutout 19*c* extending from the foot insertion opening corresponding portion 190 of the inner side knitted fabric portion 19 toward the toe is formed. The left side portion of the outer side knitted fabric portion 11 and the right side portion on the far side in the plane of drawing are not connected at the position of the outer side cutout 11*c*, and the outer side knitted fabric portion 11 in the region IV is knitted to a C-shape having the left side in the plane of drawing as a turn-back end. Similarly, the left side portion of the inner side knitted fabric portion 19 and the right side portion on the far side in the plane of drawing are not connected at the position of the inner side cutout 19*c*, and the inner side knitted fabric portion 19 in the region IV is knitted to a C-shape having the right side in the plane of drawing as a turn-back end.

Figure 3:
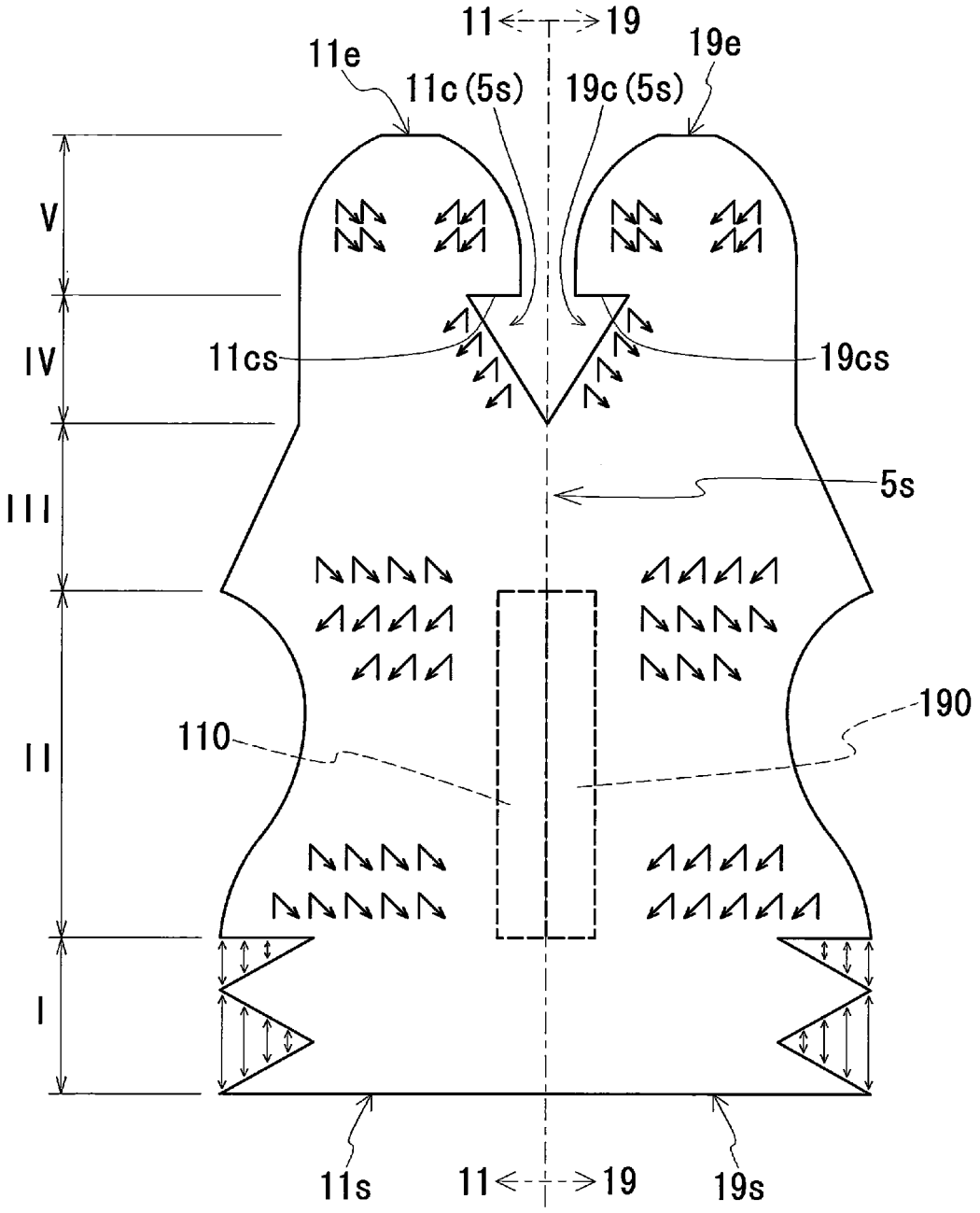
FIG. 3 is a schematic view showing a knitting procedure of the shoe upper shown in the first embodiment.

Although not shown in FIG. 3, a hole is formed in the knitted fabric portions 11, 19 by carrying out stitch move and the like at the portion near the connecting boundary in the regions III, IV. This hole becomes the eyelet hole 60 when the shoe upper 1 is completed (see FIGS. 1, 2).

The inside narrowing carried out in the region IV is carried out to form the cutouts 11*c*, 19*c*, which are to become the ends of the slit 5*s*. Thus, when the slit 5*s* does not need to be formed in the shoe upper 1, the outer side knitted fabric portion 11 and the inner side knitted fabric portion 19 are respectively knitted to a tubular shape using different yarn feeders without forming the cutouts 11*c*, 19*c*.

Lastly, the region V of the knitted fabric portions 11, 19 is knitted. In the region V, set up portions 11*cs*, 19*cs* are first formed at the positions of the cutouts 11*c*, 19*c*. The set up portions 11*cs*, 19*cs* are portions to become the end 51 of the slit 5*s* of FIG. 1. After knitting such set up portions 11*cs*, 19*cs*, the region V of the knitted fabric portions 11, 19 is individually knitted. Basically, the inside narrowing is carried out while carrying out the tubular knitting to form the tapered shape of the toe of the shoe upper 1. The end in the wale direction of the knitted fabric portions 11, 19 is then subjected to a bind-off process and the like to form knitting end portions 11*e*, 19*e*, and the knitting of the outer side knitted fabric portion 11 and the inner side knitted fabric portion 19 is terminated.

The completed outer side knitted fabric portion 11 and the inner side knitted fabric portion 19 are in a state connected to a tubular shape. The knitted fabric portions 11, 19 are locally bulged out or caved in by an amount the knitting width is changed by carrying out the inside widening and the inside narrowing. Such bulge and hollow correspond to the three-dimensional shape of the shoe upper 1.

According to the knitting procedure described above, the outer side knitted fabric portion 11 and the inner side knitted fabric portion 19 are knitted all at once, so that the knitted fabric portions 11, 19 can be completed in a short period of time. The knitting zone in the knitting width direction becomes longer by the amount the knitted fabric portions 11, 19 are lined on the left and right, so that the knitting speed can be easily accelerated and as a result, the knitted fabric portions 11, 19 can be completed in a short time.

In the knitting procedure described above, the knitting is carried out from the heel toward the toe of the shoe upper 1, and thus the shoe upper 1 can be efficiently knitted. When carrying out the knitting from the heel toward the toe, the knitting width is gradually narrowed as a whole although the knitting width is widened/narrowed in the process. Thus, when the knitting is carried out from the heel toward the toe, the number of times to carry out the knitting of increasing the stitches can be reduced. Since the knitting of increasing the stitches is more troublesome than the knitting of reducing the stitches, the shoe upper 1 can be efficiently knitted if the number of times for the knitting of increasing the stitches can be reduced. Furthermore, when carrying out the knitting from the heel toward the toe, the area of processing the knitting end portion (bind-off process) that is troublesome can be reduced since the toe has a tapered shape. This also contributes to enhancing the efficiency of the knitting of the shoe upper 1.

[Process β]

After the knitting of the outer side knitted fabric portion 11 and the inner side knitted fabric portion 19 according to the knitting procedure shown in FIG. 3 is terminated, the inner side knitted fabric portion 19 is tucked in the interior of the outer side knitted fabric portion 11 to form the shoe upper 1 having a double structure. In this case, the outer side knitted fabric portion 11 and the inner side knitted fabric portion 19 are connected at the position of the foot insertion opening corresponding portions 110, 190, so that the alignment of the inner side knitted fabric portion 19 with respect to the outer side knitted fabric portion 11 is easily carried out.

[Process γ]

The shoe upper 1 having the double structure is fitted to a last and thermally processed. Upon carrying out the thermal process, the heat fusible yarn of the fusible knitting yarn is melted, and the outer side knitted fabric portion 11 and the inner side knitted fabric portion 19 are adhered by the melted heat fusible yarn, and the shoe upper 1 having the double structure is formed into a shape corresponding to the last.

According to the method for producing the shoe upper of the first embodiment described above, the shoe upper 1 having the double structure can be produced with high productivity.

Second Embodiment

In the first embodiment, the knitting is carried out from the heel toward the toe of the shoe upper 1 to produce the shoe upper 1. On the contrary, the knitting may be carried out from the toe toward the heel of the shoe upper 1. In the second embodiment, the procedure of knitting from the toe toward the heel will be briefly described with reference to FIG. 3.

In the second embodiment, the outer side knitted fabric portion 11 is set up at the position indicated with a reference number 11*e*, and the inner side knitted fabric portion 19 is set up at the position indicated with a reference number 19*e*. Thereafter, the knitted fabric portions 11, 19 are knitted in the order of the region V→region IV→region III→region II→region I, and lastly, the knitting of the outer side knitted fabric portion 11 and the inner side knitted fabric portion 19 is terminated at the position indicated with reference numerals 11*s*, 19*s*.

The present invention is not limited to the configuration of the embodiments described above, and the present invention may be appropriately modified within a scope not deviating from the gist of the present invention.

Description of Symbols

1 shoe upper
2 sole cover section
3 instep cover section
35 foot insertion opening rim
5 shoe opening
5*i* foot insertion opening
5*s* slit
51 end
60 eyelet hole
11 outer side knitted fabric portion
11*s* set up portion
11*e* knitting end portion
110 foot insertion opening corresponding portion
11*c* outer side cutout
11*cs* set up portion
19 inner side knitted fabric portion
19*s* set up portion
19*e* knitting end portion
190 foot insertion opening corresponding portion
19*c* inner side cutout
19*cs* set up portion

The invention claimed is:

1. A method for producing a shoe upper of producing a shoe upper using a flat knitting machine including at least a pair of a front and a back needle bed and a yarn feeder for feeding a knitting yarn; the method comprising the processes of:

process α of knitting a tubular inner side knitted fabric portion to become an inner side portion of the shoe upper and a tubular outer side knitted fabric portion to become an outer side portion of the shoe upper with the inner side knitted fabric portion and the outer side knitted fabric portion lined on left and right on the needle beds and with foot insertion opening corresponding portions of the knitted fabric portions connected;

process β of tucking the inner side knitted fabric portion in an interior of the outer side knitted fabric portion to form a shoe upper having a double structure; and process γ of fitting the shoe upper having the double structure to a last and carrying out a thermal process; wherein at least one of the inner side knitted fabric portion and the outer side knitted fabric portion is knitted using a fusible knitting yarn including a heat fusible yarn in the process α to adhere the outer side knitted fabric portion and the inner side knitted fabric portion with the heat fusible yarn melted during the thermal process in the process γ and to form the shoe upper having the double structure into a shape corresponding to the last.

2. The method for producing the shoe upper according to claim 1, wherein the inner side knitted fabric portion and the outer side knitted fabric portion are knitted from a heel toward a toe in the process α.

3. The method for producing the shoe upper according to claim 1, wherein, an inner side cutout extending from the foot insertion opening corresponding portion of the inner side knitted fabric portion toward a toe and an outer side cutout extending from the foot insertion opening corresponding portion of the outer side knitted fabric portion toward the toe are formed in the process α.

4. The method for producing the shoe upper according to claim 1, wherein knitting of thickening at least a part of the inner side knitted fabric portion and the outer side knitted fabric portion is carried out.

5. A shoe upper having a foot insertion opening, the shoe upper comprising:

an outer side knitted fabric portion, and an inner side knitted fabric portion overlapped in an interior of the outer side knitted fabric portion; wherein the outer side knitted fabric portion and the inner side knitted fabric portion are adhered by a melted heat fusible yarn;

a foot insertion opening corresponding portion of the outer side knitted fabric portion and a foot insertion opening corresponding portion of the inner side knitted fabric portion are connected with a knitting yarn; and stitches of the foot insertion opening corresponding portion of the outer side knitted fabric portion and stitches of the foot insertion opening corresponding portion of the inner side knitted fabric portion are directed in the same direction in a length direction of the shoe upper.

6. The method for producing the shoe upper according to claim 2, wherein, an inner side cutout extending from the foot insertion opening corresponding portion of the inner side knitted fabric portion toward a toe and an outer side cutout extending from the foot insertion opening corresponding portion of the outer side knitted fabric portion toward the toe are formed in the process α.

7. The method for producing the shoe upper according to claim 2, wherein knitting of thickening at least a part of the inner side knitted fabric portion and the outer side knitted fabric portion is carried out.

8. The method for producing the shoe upper according to claim 3, wherein knitting of thickening at least a part of the inner side knitted fabric portion and the outer side knitted fabric portion is carried out.

* * * * *